US005670449A

United States Patent [19]

Simpson et al.

[11] Patent Number: 5,670,449

[45] Date of Patent: Sep. 23, 1997

[54] DYE-DONOR ELEMENT CONTAINING ELASTOMERIC BEADS FOR THERMAL DYE TRANSFER

[75] Inventors: William Henry Simpson, Pittsford; Jacob John Hastreiter, Jr., Spencerport, both of N.Y.

[73] Assignee: Eastman Kodak Company, Rochester, N.Y.

[21] Appl. No.: 626,443

[22] Filed: Apr. 2, 1996

[51] Int. Cl.[6] ..... B41M 5/035; B41M 5/38

[52] U.S. Cl. ..... 503/227; 428/195; 428/206; 428/327; 428/913; 428/914

[58] Field of Search ..... 428/195, 206, 428/327, 913, 914; 503/227

[56] References Cited

U.S. PATENT DOCUMENTS 4,541,830 9/1985 Hotta et al. ..... 8/471

FOREIGN PATENT DOCUMENTS 124616 5/1988 European Pat. Off. ..... 503/227

*Primary Examiner*—Bruce H. Hess

*Attorney, Agent, or Firm*—Harold E. Cole

[57] ABSTRACT

A dye-donor element comprising a support having thereon a dye layer or an overcoat layer thereon which contains crosslinked elastomeric beads having a Tg of 45° C. or less, the elastomeric beads being made from an acrylic polymer, an acrylic copolymer or a styrenic copolymer, the elastomeric beads having from about 5 to about 40% by weight of a crosslinking agent, the beads having a particle size of from about 0.5 to about 20 μm.

20 Claims, No Drawings

DYE-DONOR ELEMENT CONTAINING ELASTOMERIC BEADS FOR THERMAL DYE TRANSFER

This invention relates to a dye-donor element used in thermal dye transfer, and more particularly to a dye-donor element containing elastomeric beads.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

EP 124,616 discloses the use of hard particles, such as silica particles, in the dye layer of a dye-donor element to prevent melt bonding of the dye-donor and dye-receiving elements during thermal printing. U.S. Pat. No. 4,541,380 discloses the use of a variety of particles, including hard polymeric particles, in a dye-donor element to reduce the number of dropouts where the dye-donor and dye-receiver elements may be in direct contact with one another.

However, there is a problem with the use of hard particles in a dye-donor element in that they have poor raw stock keeping which gives rise to a density loss on printing. Hard particles also create an unwanted space between the dye-donor and dye-receiver elements during the actual printing process by interfering with the dye diffusion process, thereby resulting in print areas of low density and image mottle.

It is an object of this invention to provide a dye-donor element containing polymeric particles which has improved raw stock keeping and less density loss upon printing.

These and other objects are achieved in accordance with the invention, which comprises a dye-donor element comprising a support having thereon a dye layer comprising a dye dispersed in a polymeric binder, the dye layer or an overcoat layer thereon containing crosslinked elastomeric beads having a glass transition temperature (Tg) of 45° C. or less, the elastomeric beads being made from an acrylic polymer, an acrylic copolymer or a styrenic copolymer, the elastomeric beads having from about 5 to about 40% by weight of a crosslinking agent, the beads having a particle size of from about 0.5 to about 20 μm.

When dye-donor element is wound up in a roll, there is a potential for transfer of material from the front side to the back. An advantage of the invention is that the elastomeric beads will act as spacer beads under the compression force of a wound up dye-donor roll. This results in improved raw stock keeping of the dye-donor roll by reducing the material transferred from the backside slipping layer to the front dye layer as measured by the reduction in sensitometric change under accelerated aging conditions.

However if inelastic, low Tg microbeads are used which are not partially crosslinked, they would flatten or deform under pressure and not provide their intended function as spacers to prevent contact between the dye-donor layer and the slipping layer in a wound-up dye-donor roll.

In contrast to prior art microbeads for dye-receivers which are harder and have a higher Tg, it has been found that the elastomeric microbeads of the invention which have a lower Tg are compressed under the weight of the thermal print head during printing, thereby allowing better contact between the dye-donor and dye-receiver elements. When microbeads having a high Tg are used, the microbeads are too rigid and prevent intimate contact between the dye-donor and dye-receiver during printing, resulting in image mottle and poor image quality. The improved dye-donor/dye-receiver contact achievable with the low Tg elastomeric microbeads of the invention results in reduced mottle and improved image quality. As noted above, the crosslinked elastomeric beads employed in the invention have a Tg of 45° C. or less, preferably 10° C. or less.

Microbead elasticity is determined by the mount of crosslinking agent employed in making the microbead. If the amount of crosslinking agent used is too high, the microbeads produced will be too rigid and will not be deformed under the pressure exerted by the thermal print head during printing, which leads to mottle and poor image quality. If the amount of crosslinking agent in the microbeads is too low, the microbeads will not only be deformed under the pressure exerted by the thermal print head, but will also undergo nonelastic flow leading to permanent deformation, making recovery of their original shape impossible.

Thus, the elastomeric microbeads used in the invention have a combination of both the proper Tg and level of crosslinking agent in order to achieve the desired degree of elasticity.

The elastomeric microbeads of the invention may be incorporated in either the dye layer or in an overcoat layer thereon. In a preferred embodiment of the invention, the elastomeric microbeads are present in the dye layer. The elastomeric microbeads may be employed in any amount effective for the intended purpose. In general, good results have been obtained at a coverage of from about 0.005 to about 0.090 g/m$^2$. As noted above, the elastomeric microbeads generally have a particle size of from about 0.5 μm to about 20 μm.

As described above the elastomeric beads used in the invention are made from an acrylic polymer or copolymer, such as butyl-, ethyl-, propyl-, hexyl-, 2-ethyl hexyl-, 2-chloroethyl-, 4-chlorobutyl- or 2-ethoxyethyl- acrylate or methacrylate; acrylic acid; methacrylic acid, hydroxyethyl acrylate, etc.; or a styrenic copolymer, such as styrene-butadiene, styrene-acrylonitrile-butadiene, styrene-isoprene, hydrogenated styrene-butadiene, etc., or mixtures thereof.

The elastomeric beads may be crosslinked with various crosslinking agents, which may also be part of the elastomeric copolymer, such as divinylbenzene; ethylene glycol diacrylate; 1,4-cyclohexylene-bis(oxyethyl) dimethacrylate; 1,4-cyclohexylene-bis(oxypropyl)diacrylate; 1,4-cyclohexylene-bis(oxypropyl) dimethacrylate; ethylene glycol diacrylate; etc.

The glass transition temperatures referred to below were determined by the method of differential scanning calorimetry (DSC) at a scanning rate of 20° C./minute and the onset in the change in heat capacity was taken as the Tg.

Following are examples of typical elastomeric microbeads which may be employed in the invention:

Bead 1) EXL5137 acrylic terpolymer microbeads (Rohm & Haas Co.) having a nominal diameter of approximately 6 to 8 μm and a Tg of approximately −33° C.

Bead 2) poly(butyl acrylate-co-divinylbenzene) (80:20 mole ratio) having a nominal diameter of approximately 4 μm and a Tg of approximately −31° C.

Bead 3) poly(styrene-co-butyl acrylate-co-divinylbenzene) (40:40:20 mole ratio) having a nominal diameter of approximately 4 μm and a Tg of approximately 45° C.

Bead 4) poly(ethyl acrylate-co-ethylene glycol diacrylate) (90:10 mole ratio) having a nominal diameter of approximately 5 μm and a Tg of approximately −22° C.

Bead 5) poly(2-ethylhexyl acrylate-co-styrene-co-divinylbenzene) (45:40:15 mole ratio) having a nominal diameter of approximately 5 μm and a Tg of approximately 20° C.

Bead 6) poly[2-chloroethylacrylate-co-1,4-cyclohexylene-bis(oxypropyl) diacrylate] (80:20 mole ratio) having a nominal diameter of approximately 7 μm and a Tg of approximately −10° C.

Bead 7) poly(butyl methacrylate-co-hydroxyethyl-acrylate-co-divinylbenzene) (65:10:25 mole ratio) having a nominal diameter of approximately 6 μm and a Tg of approximately 29° C.

Bead 8) poly(styrene-co-butadiene-co-divinylbenzene) (40:50:10 mole ratio) having a nominal diameter of approximately 8 μm and a Tg of approximately −55° C.

Bead 9) poly(styrene-co-2-ethoxyethyl acrylate-co-ethylene glycol diacrylate) (20:45:35 mole ratio) having a nominal diameter of approximately 4 μm and a Tg of approximately −5° C.

Bead 10) poly(styrene-co-hexyl acrylate-co-divinylbenzene) (10:70:20 mole ratio) having a nominal diameter of approximately 4 μm and a Tg of approximately −15° C.

The dye image-receiving layer of the dye-receiving element employed with the dye-donor element of the invention may comprise, for example, a polycarbonate, a polyurethane, a polyester, polyacrylate, poly(vinyl chloride), poly(styrene-co-acrylonitrile), polycaprolactone or mixtures thereof. The dye image-receiving layer may be present in any amount which is effective for the intended purpose. In general, good results have been obtained at a concentration of from about 1 to about 10 g/m$^2$. An overcoat layer may be further coated over the dye-receiving layer, such as described in U.S. Pat. No. 4,775,657, the disclosure of which is incorporated by reference.

The support for the dye-receiving element employed with the dye-donor element of the invention may be transparent or reflective, and may comprise a polymeric, a synthetic paper, or a cellulosic paper support, or laminates thereof. Examples of transparent supports include films of poly(ether sulfone)s, poly(ethylene naphthalate), polyimides, cellulose esters such as cellulose acetate, poly(vinyl alcohol-co-acetal)s, and poly(ethylene terephthalate). The support may be employed at any desired thickness, usually from about 10 μm to 1000 μm. Additional polymeric layers may be present between the support and the dye image-receiving layer. For example, there may be employed a polyolefin such as polyethylene or polypropylene. White pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965241, the disclosures of which are incorporated by reference. The receiver element may also include a backing layer such as those disclosed in U.S. Pat. Nos. 5,011,814 and 5,096,875, the disclosures of which are incorporated by reference. In a preferred embodiment of the invention, the support comprises a microvoided thermoplastic core layer coated with thermoplastic surface layers as described in U.S. Pat. No. 5,244,861, the disclosure of which is hereby incorporated by reference.

Any dye can be used in the dye-donor of the invention provided it is transferable to the dye-receiving layer by the action of heat. Especially good results have been obtained with sublimable dyes. Dye-donor elements applicable for use in the present invention are described, e.g., in U.S. Pat. Nos. 4,916, 112, 4,927,803 and 5,023,228, the disclosures of which are incorporated by reference.

As noted above, dye-donor elements are used to form a dye transfer image. Such a process comprises imagewise heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements employed in the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used such as lasers.

A thermal dye transfer assemblage of the invention comprises (a) a dye-donor element as described above, and (b) a dye-receiving element, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Bead Preparation

A limited coalescence process was used to prepare microbeads containing the appropriate monomers. A monomer phase with a free radical initiator was mixed with an aqueous phase containing poly(methylamino-ethanol adipate) and colloidal silica. The resulting dispersion was passed through a Gaulin Homogenizer to give monomer droplets of a certain size suspended in the aqueous phase. The mixture was then heated at 55° C. for sixteen hours. The microbeads were collected, washed with water and dried.

The procedure for making Bead 3) or poly(styrene-co-butyl acrylate-co-divinylbenzene) (40:40:20) microbeads was as follows:

A monomer mixture of 200 g styrene, 200 g butyl acrylate, 100 g divinylbenzene, and 5 g Vazo 52 (an azo-initiator from DuPont) was combined with a mixture of 6.3 g poly(methylaminoethanol adipate), and 135 g Nalcoag 1060 dispersing agent (Nalco Co.) in 4 L water. The mixture was stirred rapidly with a laboratory stirrer to obtain a crude emulsion. The crude emulsion was then passed through a Gaulin Homogenizer to obtain 4 μm monomer droplets in water. The resulting suspension was heated at 55° C. overnight in a 5 L flask to polymerize the monomer droplets. The mixture was cooled and the polymer beads were isolated by filtration. The beads were washed with water and then dried in a vacuum oven.

The procedure for making Bead 2) or poly(butyl acrylate-co-divinylbenzene) (80:20) microbeads was similar to the above procedure, except that styrene was omitted and the amount of butyl acrylate used was 400 g.

EXAMPLE 2

The following materials were used in the dye-donor elements described below:

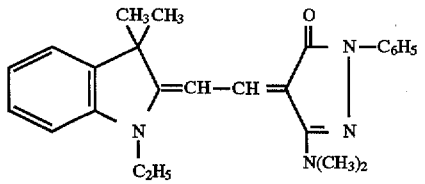

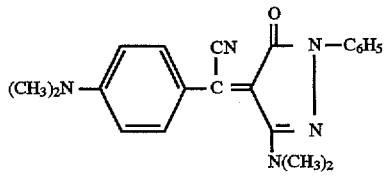

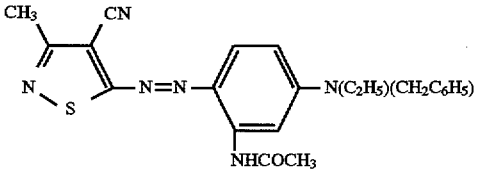

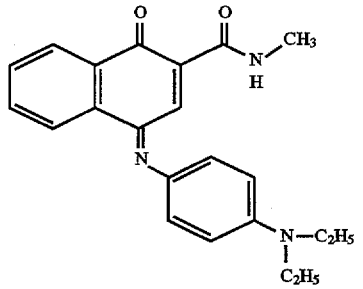

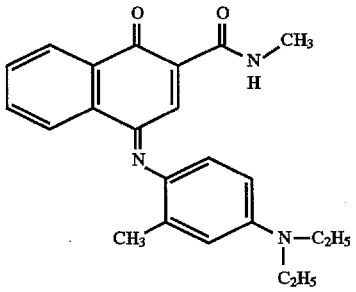

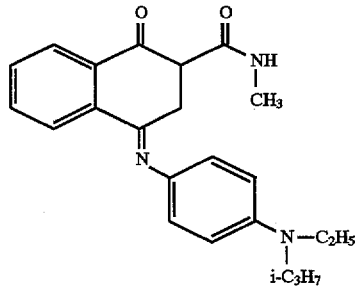

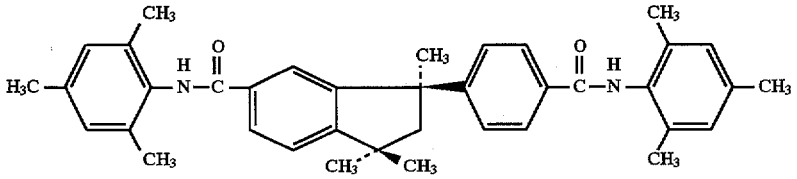

Dye-Donor Element

Dye-donor elements were prepared by coating on one side of a 6 μm poly(ethylene terephthalate) PET film, which had been subbed on both sides with Tyzor TBT® titanium tetrabutoxide (DuPont Corp.), the following layer: slipping layer of poly(vinyl acetal) (Sekisui Co.) (0.383 g/m$^2$), candelilla wax (0.0215 g/m$^2$), p-toluenesulfonic acid (0.0003 g/m$^2$), and an aminopropyl dimethyl-terminated polydimethylsiloxane, PS513 (Petrarch Systems, Inc.) (0.0108 g/m$^2$)

On the other side of the above PET support was coated one of the following dye layers:

Yellow dye-donor:

Dye 1 (0.269 g/m$^2$), CAP 0.5 cellulose acetate propionate, 0.5 s viscosity, (Eastman Chemicals Co.), (0.072 g/m$^2$) CAP 20 cellulose acetate propionate, 20 s viscosity, (Eastman Chemicals Co.) (0.287 g/m$^2$), and Fluorad FC-430® surfactant (3M Corp.).

Magenta dye-donor:

Dye 2 (0.184 g/m$^2$), Dye 3 (0.169 g/m$^2$), monomeric glass (0.066 g/m$^2$), CAP 0.5 (0.169 g/m$^2$), CAP 20 (0.308 g/m$^2$), and Fluorad FC-430® (0.0022 g/m$^2$).

Cyan dye-donor:

Dye 4 (0.127 g/m$^2$), Dye 5 (0.115 g/m$^2$), Dye 6 (0.275 g/m$^2$), CAP 20 (0.295 g/m$^2$), and Fluorad FC-430® (0.0022 g/m$^2$).

The beads to be evaluated were added to the above melt solutions resulting in the following test donors:

Control 1: yellow dye-donor plus 0.0054 g/m$^2$ of inelastic, hard divinylbenzene microbeads (average diameter 2 μm);

Control 2: magenta dye-donor plus 0.0064 g/m$^2$ of the same hard, inelastic microbeads used for Control 1;

Control 3: cyan dye-donor plus 0.0108 g/m$^2$ of the same hard, inelastic microbeads used for Control 1;

Control 4: yellow dye-donor plus 0.045 g/m$^2$ of 4 μm divinylbenzene microbeads;

Control 5: magenta dye-donor plus 0.050 g/m$^2$ of the microbeads used in Control 4;

Control 6: cyan dye-donor plus 0.011 g/m$^2$ of the microbeads used in Control 4;

The following dye-donors according to the invention were similarly prepared:

E-1: yellow dye-donor plus 0.0054 g/m$^2$ of Bead 1

E-2: magenta dye-donor plus 0.0064 g/m$^2$ of Bead 1

E-3: cyan dye-donor plus 0.0108 g/m$^2$ of Bead 1

E-4: cyan dye-donor plus 0.089 g/m$^2$ of Bead 1

E-5: cyan dye-donor plus 0.011 g/m$^2$ of Bead 3

E-6: cyan dye-donor plus 0.089 g/m$^2$ of Bead 3

E-7: cyan dye-donor plus 0.050 g/m$^2$ of Bead 2;

E-8: yellow dye-donor plus 0.045 g/m$^2$ of Bead 1

E-9: magenta dye-donor plus 0.050 g/m$^2$ of Bead 1

Samples of the dye-donor elements were aged artificially by wrapping approximately 5 m of each around separate plastic spools and placing each spool into an aluminum foil bag which was sealed. The bags were then placed in an oven at 60° C. for three days. Afterwards the dye-donor elements were removed from the spool and laminated with a thermal receiver material and placed under a thermal printing head for printing an image.

Dye-Receiving Element

A subbing layer of a mixture of an aminofunctional organo-oxysilane Prosil 221® with a hydrophobic organo-oxysilane, Prosil 2210®, which is an epoxy-terminated organo-oxysilane, was coated onto a support of Oppalyte® polypropylene-laminated paper support with a lightly $TiO_2$-pigmented polypropylene skin (Mobil Chemical Co.) at a dry coverage of 0.11 g/m$^2$. Prior to coating, the support was subjected to a corona discharge treatment at approximately 450 joules/m$^2$.

Each sample was overcoated with a dye-receiving layer containing Makrolon® KL3-1013 polyether-modified bisphenol-A polycarbonate block copolymer (Bayer AG) (1.78 g/m$^2$), GE Lexan® 141-112 bisphenol-A polycarbonate (General Electric Co.) (1.44 g/m$^2$), Fluorad FC-431 ® perfluorinated alkylsulfon-amidoalkyl ester surfactant (3M Co.) (0.012 g/m$^2$), di-n-butyl phthalate (0.32 g/m$^2$), and diphenyl phthalate (0.32 g/m$^2$) coated from a dichloromethane/-trichloroethylene solvent mixture.

The dye-receiving layer was then overcoated with a polycarbonate random terpolymer of bisphenol A (50 mole %), diethylene glycol (49 mole %), and polydimethylsiloxane (1 mole %), (2500 MW) block units (0.65 g/m$^2$); Fluorad FC-431® surfactant (0.016 g/m$^2$); and DC-510 surfactant (Dow-Corning Corp.)(0.009 g/m$^2$) dissolved in a dichloromethane/trichloroethylene solvent mixture.

Printing Conditions

The imaged prints were prepared by placing the dye-donor element in contact with the polymeric receiving layer side of the dye-receiver element. The assemblage was fastened to the top of the motor driven 53 mm diameter rubber roller and a TDK thermal head L-231, thermostated at 24° C. with a head load of 2 kg pressed against the robber roller. The TDK L-231 thermal print head has 512 independently addressable heaters with a resolution of 5.4 dots/mm and an active printing width of 95 mm, of average heater resistance 512Ω. The imaging electronics were activated and the assemblage was drawn between the printing head and roller at 20.6 mm/s. Coincidentally, the resistive elements in the thermal print head were pulsed on for 128 μs every 130 μs. Printing maximum density requires 128 pulses "on" time per printed line of 4 μs. The images were printed with a 1:1 aspect ratio. The maximum printing energy was 5.2 J/cm$^2$.

The printed image consisted of small squares, each printed at a uniform, but different, energy. A reflection dye density for each square was measured by using an X-Rite Sensitometer (X-Rite Corp., Grandville, Mich.) with Status A filters. A plot was made of Status A density versus printing energy for each square. The curves were compared at a density of 0.5 for analysis.

Table 1 shows the shift in printing energy needed to attain a density of 0.5 after aging the wrapped donor at 60° C. for 3 days. The most desirable effect would be an absolute change approaching zero.

TABLE I

| | ENERGY CHANGE (mJ/$^2$cm) |
|---|---|
| Control 1 | +169 |
| Control 2 | −141 |
| Control 3 | −222 |
| E-1 | +106 |
| E-2 | 0 |
| E-3 | −127 |
| E-4 | −106 |
| E-5 | −116 |
| E-6 | +85 |
| E-7 | 0 |

The above results show that the largest change was observed for the control yellow, magenta and cyan dye-donor containing the hard, inelastic beads. The elastic beads contained in E-1 through E-7 exhibited smaller printing energy shifts after the same accelerated aging, which represents an improvement in the raw stock keeping of the dye-donor.

Table 2 shows the densities obtained at an energy of 2.4 J/cm$^2$.

TABLE 2

| | DENSITY AT 2.4 J/cm$^2$ |
|---|---|
| CONTROL 4 | 0.23 |
| CONTROL 5 | 0.19 |
| CONTROL 6 | 0.38 |
| E-8 | 0.42 |
| E-9 | 0.36 |
| E-3 | 0.43 |

The above results show that larger beads are better for improved keeping of the dye-donor, but the hard, inelastic beads of 4 μm in diameter used in Control 4 through 6 produced a mottled effect in the printed image which resulted in a lower status A density than those observed with the experimental dye-donors.

The elastic beads described in E-1 through E-7 can be used with a diameter as large as 8 μm because they are compressed under the force of the printing head, which allows intimate contact between dye-donor and receiver, resulting in less mottle and higher print densities.

An added improvement is that the force in the wrapped donor is not enough to compress the beads allowing them to provide better standoff because of the larger diameter.

The invention has been described in detail with particular reference to preferred embodiments thereof, but it will be understood that variations and modifications can be effected within the spirit and scope of the invention.

What is claimed is:

1. A dye-donor element comprising a support having thereon a dye layer comprising a dye dispersed in a polymeric binder, said dye layer or an overcoat layer thereon containing crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 0.5 to about 20 μm.

2. The element of claim 1 wherein said elastomeric beads have a Tg of 10° C. or less.

3. The element of claim 1 wherein said elastomeric beads are made of poly(butyl acrylate-co-divinylbenzene).

4. The element of claim 1 wherein said elastomeric beads are made of poly(styrene-co-butyl acrylate-co-divinylbenzene).

5. The element of claim 1 wherein said elastomeric beads are made of an acrylic terpolymer.

6. The element of claim 1 wherein said elastomeric beads are present at a coverage of from about 0.005 to about 0.09 $g/m^2$.

7. The element of claim 1 wherein said beads are contained in said dye layer.

8. A process of forming a dye transfer image comprising:

a) imagewise-heating a dye-donor element comprising a support having thereon a dye layer comprising a dye dispersed in a binder, and b) transferring a dye image to a dye-receiving element comprising a support having thereon a dye image-receiving layer to form said dye transfer image, wherein said dye-donor element contains crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 0.5 to about 20 μm.

9. The process of claim 8 wherein said elastomeric beads have a Tg of 10° C. or less.

10. The process of claim 8 wherein said elastomeric beads are made of poly(butyl acrylate-co-divinylbenzene).

11. The process of claim 8 wherein said elastomeric beads are made of poly(styrene-co-butyl acrylate-co-divinylbenzene).

12. The process of claim 8 wherein said elastomeric beads are made of an acrylic terpolymer.

13. The process of claim 8 wherein said elastomeric beads are present at a coverage of from about 0.005 to about 0.09 $g/m^2$.

14. The process of claim 8 wherein said beads are contained in said dye layer.

15. A thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, wherein said dye-donor element contains crosslinked elastomeric beads having a Tg of 45° C. or less, said elastomeric beads being made from an acrylic polymer, an acrylic copolymer or a styrenic copolymer, said elastomeric beads having from about 5 to about 40% by weight of a crosslinking agent, said elastomeric beads having a particle size of from about 0.5 to about 20 μm.

16. The assemblage of claim 15 wherein said elastomeric beads have a Tg of 10° C. or less.

17. The assemblage of claim 15 wherein said elastomeric beads are made of poly(butyl acrylate-co-divinylbenzene).

18. The assemblage of claim 15 wherein said elastomeric beads are made of poly(styrene-co-butyl acrylate-co-divinylbenzene).

19. The assemblage of claim 15 wherein said elastomeric beads are made of an acrylic terpolymer.

20. The assemblage of claim 15 wherein said beads are contained in said dye layer.

* * * * *

UNITED STATES PATENT AND TRADEMARK OFFICE

CERTIFICATE OF CORRECTION

PATENT NO. : 5,670,449

DATED : September 23, 1997

INVENTOR(S) : William H. Simpson and Jacob J. Hastreiter, Jr.

It is certified that error appears in the above-identified patent and that said Letters Patent is hereby corrected as shown below:

On the title page, after item [22], insert --Related U.S. Application Data [60] Provisional Application Serial No. 60/008,048, filed October 30, 1995.--

In Column 1, line 4, insert --CROSS REFERENCE TO RELATED APPLICATION

Reference is made to and priority claimed from U.S. Provisional Application Serial No. 60/008,048, filed 30 October 1995, entitled DYE-DONOR ELEMENT CONTAINING ELASTOMERIC BEADS FOR THERMAL DYE TRANSFER--.

Signed and Sealed this

Seventeenth Day of March, 1998

*Attest:*

Bruce Lehman

BRUCE LEHMAN

*Attesting Officer*

*Commissioner of Patents and Trademarks*